US010178751B2

(12) United States Patent
Usami et al.

(10) Patent No.: US 10,178,751 B2
(45) Date of Patent: Jan. 8, 2019

(54) IGNITION PLUG

(71) Applicant: NGK Spark Plug Co., LTD., Nagoya (JP)

(72) Inventors: Kohei Usami, Kasugai (JP); Kenji Ban, Gifu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/938,368

(22) Filed: Mar. 28, 2018

(65) Prior Publication Data

US 2018/0288864 A1 Oct. 4, 2018

(30) Foreign Application Priority Data

Mar. 31, 2017 (JP) ..... 2017-69841

(51) Int. Cl.

| | |
|---|---|
| ***H01T 13/32*** | (2006.01) |
| ***H01T 13/52*** | (2006.01) |
| ***H01T 13/20*** | (2006.01) |
| ***H01T 13/34*** | (2006.01) |
| ***H05H 1/52*** | (2006.01) |

(52) U.S. Cl.

CPC ..... *H05H 1/52* (2013.01); *H01T 13/20* (2013.01); *H01T 13/32* (2013.01); *H01T 13/34* (2013.01); *H01T 13/52* (2013.01)

(58) Field of Classification Search

CPC ..... H01T 13/32; H01T 13/34; H01T 13/20; H01T 13/52

See application file for complete search history.

(56) References Cited

U.S. PATENT DOCUMENTS

| | | | | |
|---|---|---|---|---|
| 4,261,085 | A * | 4/1981 | Nishio | H01T 13/38 313/141 |
| 4,264,844 | A * | 4/1981 | Axe | H01T 13/50 313/120 |
| 4,439,708 | A * | 3/1984 | Hattori | H01T 13/39 313/140 |
| 2007/0114898 | A1* | 5/2007 | Nagasawa | F02P 3/0884 313/141 |
| 2014/0026848 | A1 | 1/2014 | Abe et al. | |
| 2016/0369764 | A1* | 12/2016 | Ban | F02P 9/007 |
| 2018/0041013 | A1* | 2/2018 | Saito | F02P 15/00 |

FOREIGN PATENT DOCUMENTS

| | | |
|---|---|---|
| JP | 2014-26754 A | 2/2014 |

* cited by examiner

*Primary Examiner* — Mariceli Santiago
(74) *Attorney, Agent, or Firm* — Leason Ellis LLP

(57) ABSTRACT

An ignition plug includes a center electrode; a cylindrical insulator that surrounds at least the circumference of a front end portion of the center electrode and that includes a bottom portion at the front side; and a cylindrical metal shell that holds the insulator from the outer circumference side. The center electrode includes a shaft portion that extends along an axial line and a head portion disposed at a front end of the shaft portion. The head portion has a width greater than that of the shaft portion in the radial direction. The insulator includes a first and second insulator. The first insulator has an axial hole and a diameter smaller than the maximum diameter of the head portion. The second insulator is joined to the first insulator. The shaft portion is disposed in the axial hole of the first insulator. The second insulator encloses the head portion.

6 Claims, 3 Drawing Sheets

IGNITION PLUG

This application claims the benefit of Japanese Patent Application No. 2017-69841 filed Mar. 31, 2017, which is incorporated herein by reference in its entirety.

FIELD OF THE INVENTION

The present invention relates to an ignition plug, and more specifically, it relates to an ignition plug that utilizes non-equilibrium plasma.

BACKGROUND OF THE INVENTION

An ignition plug attached to an internal combustion engine utilizes non-equilibrium plasma (Japanese Unexamined Publication No. 2014-26754). A bottomed cylindrical insulator of the ignition plug is held by a metal shell and encloses the front end of a center electrode. When an electric discharge occurs between the metal shell and the center electrode of the ignition plug, a gas is ionized (non-equilibrium plasma) to cause an air-fuel mixture to generate a flame kernel. According to the conventional technology disclosed in Japanese Unexamined Publication No. 2014-26754, the outer diameter at the front side of the insulator is reduced to thin the wall thickness at the front side of the insulator in order to increase the amount of plasma generation per unit area at the front side, which is exposed in a combustion chamber, of the insulator.

TECHNICAL PROBLEM

However, in the aforementioned conventional technology, the surface area at the front side of the insulator is reduced because the outer diameter at the front side of the insulator is reduced. As a result, there is an issue where a plasma generation region at the front side of the insulator narrows, and ignitability is lowered.

The present invention has been made in order to solve the aforementioned issue, and the object of the present invention is to provide an ignition plug having excellent ignitability by thinning the wall thickness while ensuring the surface area at the front side of the insulator.

SUMMARY OF THE INVENTION

Solution to Problem

In order to achieve the object, the ignition plug according to the present invention includes a rod-shaped center electrode that extends from a front side to a rear side along an axial line; a cylindrical insulator that surrounds at least a circumference of a front end portion of the center electrode and that has a bottom portion at the front side; and a cylindrical metal shell that holds an outer circumference side of the insulator. The center electrode includes a shaft portion extending along the axial line and a head portion disposed at a front end of the shaft portion. The head portion has a width greater than that of the shaft portion in radial direction of the center electrode. The insulator includes a first insulator that has an axial hole and has a diameter smaller than a maximum diameter of the head portion. The insulator also has a second insulator that is joined to the first insulator. The shaft portion is disposed in the axial hole of the first insulator. The second insulator encloses the head portion.

Advantageous Effects of Invention

In the first embodiment, a center electrode includes a shaft portion that extends along an axial line and a head portion that is disposed at a front end of the shaft portion. The head portion has a width greater than that of the shaft portion in the radial direction. Therefore, the wall thickness of the insulator can be thinned without reducing the outer diameter at the front side of the insulator (that is, while ensuring the surface area at the front side of the insulator). Thus, a plasma generation region can be widened, and ignitability can be improved.

In addition, the insulator includes a first insulator that has an axial hole having a diameter smaller than a maximum diameter of the head portion and in which the shaft portion is disposed; and a second insulator that encloses the head portion. Thus, the wall thickness of the first insulator surrounding the shaft portion can be thickened compared with the wall thickness of the second insulator surrounding the head portion. Therefore, much plasma can be generated at an outer surface of the second insulator while current penetration in the first insulator is suppressed. Moreover, the insulator enables the center electrode to be easily disposed in the insulator because the insulator includes the two members of the first insulator and the second insulator.

In the second embodiment, a large-diameter portion of the first insulator protrudes outward in the radial direction, and a shelf portion of the metal shell is provided on the front side of the large-diameter portion. The shelf portion protrudes inward further than the large-diameter portion in the radial direction over the entire circumference. The large-diameter portion of the first insulator is supported by the shelf portion of the metal shell. When the large-diameter portion is provided at the first insulator of the insulator covering the shaft portion, the thickness in the radial direction of the large-diameter portion can be thickened compared with the case where the large-diameter portion is provided at the second insulator that encloses the head portion widening further than the shaft portion in the radial direction. Therefore, in addition to the effect in the first embodiment, the mechanical strength of the large-diameter portion can be ensured.

In the third embodiment, the surface area of the second insulator can be increased because the outer diameter of at least a portion of the second insulator on the front side of the metal shell is larger than a minimum inner diameter of the shelf portion. In addition, the surface area of the second insulator can be increased while the thickness of the insulator is comparatively thinned at a portion near a location in the vicinity of the center of a combustion chamber because the center electrode includes, at the front end, the head portion widening further than the shaft portion in the radial direction. Therefore, in addition to the effect in the second embodiment, the amount of plasma generation can be increased.

In the fourth embodiment, the head portion is disposed on the front side of the front end of the metal shell. Penetration easily occurs at a portion of the insulator between the metal shell and the center electrode; however, a portion (portion having a thin wall thickness) of the second insulator surrounding the head portion can be prevented from being disposed inside the metal shell by disposing the head portion on the front side of the front end of the metal shell. Therefore, in addition to the effect in any of first to third embodiments, the penetration in the insulator can be further prevented from easily occurring.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
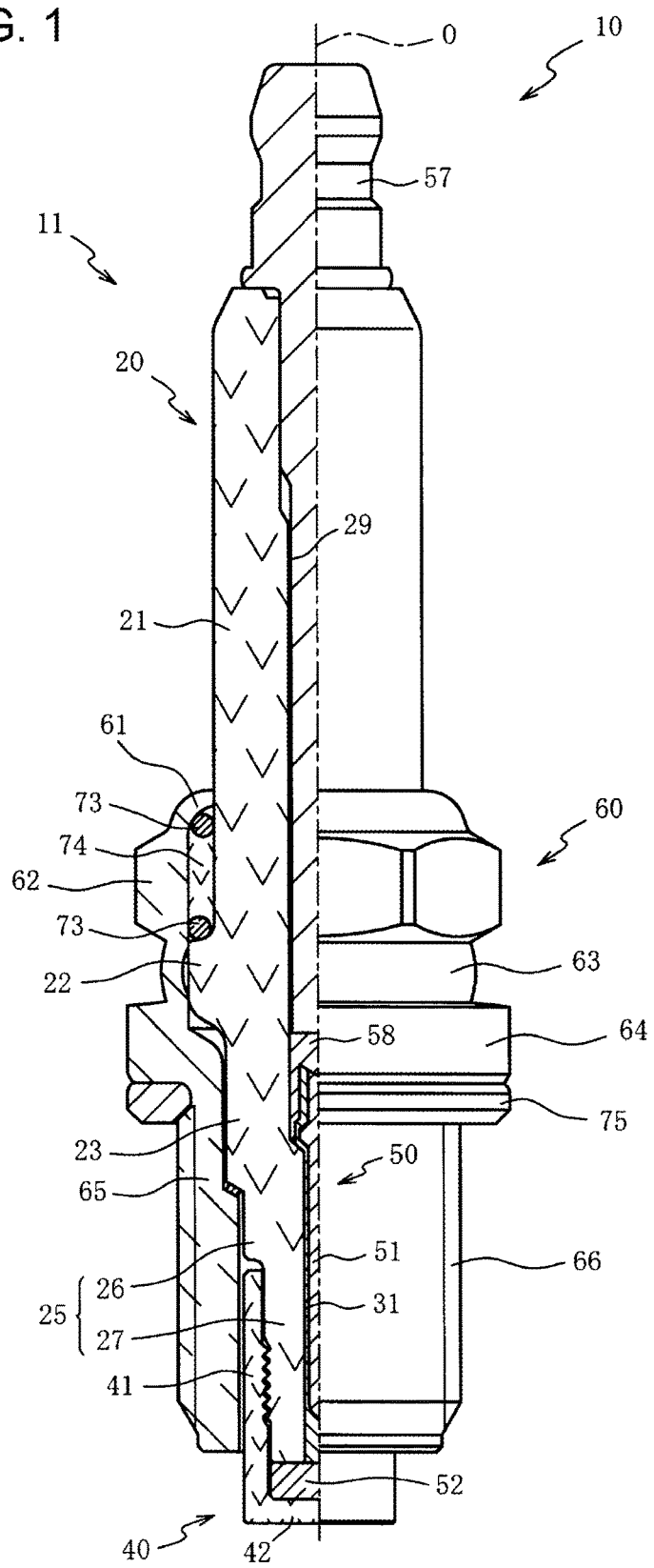
FIG. 1 is a half sectional view of an ignition plug according to a first embodiment of the present invention.
Figure 2:
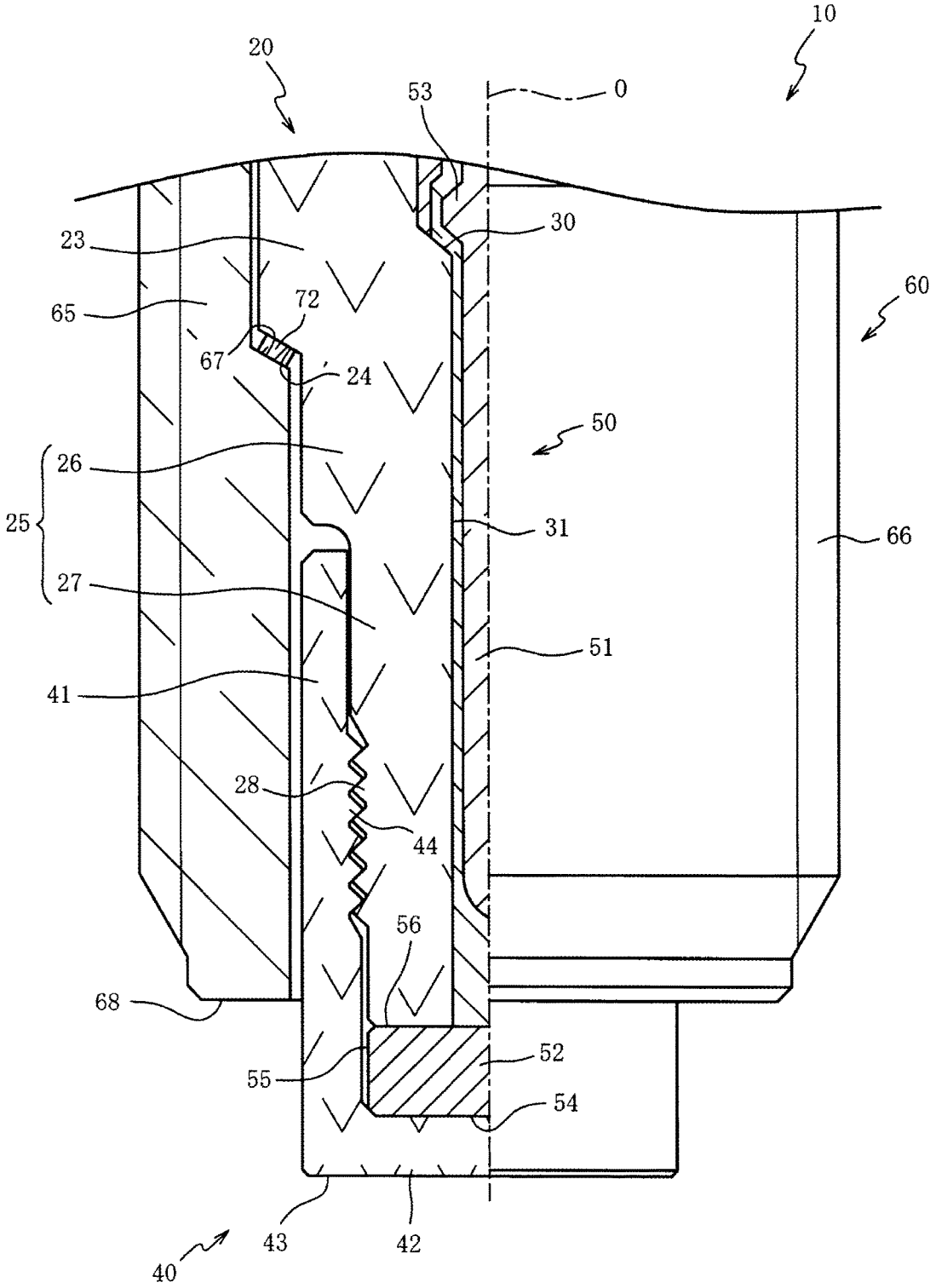
FIG. 2 is an enlarged half sectional view of a portion of the ignition plug.

Hereinafter, preferred embodiments of the present invention will be described with reference to the attached drawings. FIG. 1 is a half sectional view, with an axial line O as the border, of an ignition plug 10 according to a first embodiment of the present invention. FIG. 2 is an enlarged half sectional view of a portion of the ignition plug 10. In FIG. 1 and FIG. 2, the lower side of the sheet is referred to as a front side of the ignition plug 10, and the upper side of the sheet is referred to as a rear side of the ignition plug 10 (the same applies to FIG. 3). In FIG. 2, illustration of the rear side of the ignition plug 10 in the axial line O direction is omitted.

As illustrated in FIG. 1 and FIG. 2, the ignition plug 10 includes an insulator 11, a center electrode 50, and a metal shell 60. The insulator 11 is a member that is formed of alumina and the like and that is excellent in terms of mechanical characteristics and high-temperature insulation. The insulator 11 includes a substantially cylindrical first insulator 20 and a bottomed cylindrical second insulator 40.

In the first insulator 20, a trunk portion 21, a protruding portion 22, a large-diameter portion 23, and a small-diameter portion 25 are connected together in this order along the axial line O from the rear side to the front side; and a hole portion 29, a stepped portion 30, and an axial hole 31 that are formed along the axial line O extend through the center. The trunk portion 21 is positioned at the rear side of the first insulator 20. The protruding portion 22 expands outward in a radial direction, in a flange shape, from the border between the trunk portion 21 and the large-diameter portion 23. The protruding portion 22 is provided around the entire circumference of the border between the trunk portion 21 and the large-diameter portion 23.

The small-diameter portion 25 provided on the front side of the large-diameter portion 23 includes a first small-diameter portion 26 and a second small-diameter portion 27. The second small-diameter portion 27 is disposed on the front side of the first small-diameter portion 26. The outer diameter of the first small-diameter portion 26 is larger than the outer diameter of the second small-diameter portion 27 and smaller than the outer diameter of the large-diameter portion 23. Due to a difference between the outer diameter of the large-diameter portion 23 and the outer diameter of the first small-diameter portion 26, a lock portion 24 facing the front side is formed at the outer circumference of the large-diameter portion 23. The lock portion 24 has a diameter that decreases toward the front side in the axial line O direction. An external thread portion 28 is formed at the outer circumference of the second small-diameter portion 27.

The hole portion 29 is formed from the trunk portion 21 to the large-diameter portion 23. The axial hole 31 is formed from the large-diameter portion 23 to the second small-diameter portion 27. The inner diameter of the hole portion 29 is larger than the inner diameter of the axial hole 31. Due to a difference between the inner diameter of the hole portion 29 and the inner diameter of the axial hole 31, the stepped portion 30 facing the rear side is formed at the inner circumference of the large-diameter portion 23. The stepped portion 30 has a diameter that decreases toward the front side in the axial line O direction.

The second insulator 40 is a member that surrounds the circumference of the second small-diameter portion 27 of the first insulator 20. The second insulator 40 includes a cylinder portion 41 and a bottom portion 42 that forms a front end surface 43 of the second insulator 40 and that closes a front-side opening of the cylinder portion 41. An internal thread portion 44 is formed at the inner circumference of the cylinder portion 41.

The internal thread portion 44 is engaged with the external thread portion 28 formed at the outer circumference of the second small-diameter portion 27 of the first insulator 20 and joins the second insulator 40 directly to the first insulator 20. The outer diameter of the cylinder portion 41 is substantially equal to the outer diameter of the first small-diameter portion 26 of the first insulator 20. The wall thickness in the radial direction of the cylinder portion 41 is substantially equal to a difference between the outer diameter of the first small-diameter portion 26 and the outer diameter of the second small-diameter portion 27. The wall thickness in the radial direction of the cylinder portion 41 is uniform over the total length of the cylinder portion 41 in the axial line O direction. The length in the axial line O direction of the second insulator 40 is longer than the length in the axial line O direction of the second small-diameter portion 27.

The center electrode 50 is a conductive member that includes a rod-shaped shaft portion 51 and a head portion 52 provided at a front end of the shaft portion 51. In the shaft portion 51, a core material is embedded in an electrode base material that has a bottomed cylindrical shape. The core material has excellent in terms of thermal conductivity more than the electrode base material. The core material is formed of copper or an alloy containing copper as a main component. The electrode base material is formed of a nickel based alloy, nickel, or the like.

The center electrode 50 includes an engagement portion 53 provided at a rear end of the shaft portion 51. The engagement portion 53 is a portion that widens further than the shaft portion 51 in the axial right-angle direction perpendicular to the axial line O. The engagement portion 53 is disposed in the hole portion 29 of the first insulator 20 and engaged with the stepped portion 30 of the first insulator 20. The shaft portion 51 is disposed in the axial hole 31 of the first insulator 20. The inner diameter of the axial hole 31 is smaller than the maximum diameter of the head portion 52.

The head portion 52 is a portion that widens further than the shaft portion 51 in the axial right-angle direction perpendicular to the axial line O. The head portion 52 has a front end surface 54, a side surface 55, and a rear end surface 56. In the present embodiment, the head portion 52 is formed of a nickel based alloy, nickel, or the like into a circular columnar shape and joined to the front end of the shaft portion 51 by welding. The head portion 52 is disposed on the front side of the second small-diameter portion 27 of the first insulator 20 in the axial line O direction. The second insulator 40 encloses the head portion 52. The front end surface 54 of the head portion 52 is covered by the bottom portion 42 of the second insulator 40. The side surface 55 of the head portion 52 is covered by the cylinder portion 41 of the second insulator 40.

A metal terminal 57 is a rod-shaped member to which a high voltage cable (not shown) is connected. The metal terminal 57 is formed of a conductive metal material (for example, low carbon steel and the like). The front side of the metal terminal 57 is disposed in the hole portion 29 of the first insulator 20. A conductive sealing material 58 is disposed between the metal terminal 57 and the engagement portion 53 of the center electrode 50. In the sealing material 58, for example, a composition containing glass particles based on $B_2O_3$—$SiO_2$ or the like and metal particles of Cu, Fe, or the like is used. The center electrode 50 and the metal terminal 57 are electrically connected to each other in the hole portion 29 by the sealing material 58.

The metal shell 60 is a substantially cylindrical member that is secured to an internal combustion engine (not shown). The metal shell 60 is formed of a conductive metal material (for example, low carbon steel, stainless steel, and the like). In the metal shell 60, a crimping portion 61, a tool engagement portion 62, a curved portion 63, a seat portion 64, and a trunk portion 65 are connected together in this order along the axial line O from the rear side to the front side. The trunk portion 65 includes a thread portion 66 formed at the outer circumference surface.

The crimping portion 61 and the curved portion 63 are sections for crimping the first insulator 20. The tool engagement portion 62 is a section that a tool such as a wrench is engaged with when the thread portion 66 is coupled to a threaded hole (not shown) of the internal combustion engine. The seat portion 64 is a section that is positioned on the rear side of the trunk portion 65 and that protrudes outward in the radial direction in a ring shape. A ring-shaped gasket 75 is disposed between the seat portion 64 and the trunk portion 65.

A shelf portion 67 that protrudes inward in the radial direction is provided at the inner circumference of the trunk portion 65. The shelf portion 67 is provided around the entire circumference of the trunk portion 65 and has a diameter that decreases toward the front side in the axial line O direction. The inner diameter of a portion of the trunk portion 65 on the front side of the shelf portion 67 is equal to the minimum inner diameter of the shelf portion 67. A packing 72 is disposed at the shelf portion 67. The packing 72 is a circular ring-shaped plate material formed of a metal material such as a soft steel plate.

The trunk portion 65 faces the center electrode 50 via the large-diameter portion 23 and the small-diameter portion 25 of the first insulator 20 and the cylinder portion 41 of the second insulator 40. In the present embodiment, a front end 68 of the trunk portion 65 is positioned on the rear side (upper side in FIG. 2) of the front end surface 43 of the second insulator 40. Moreover, the front end 68 of the trunk portion 65 is positioned on the rear side (upper side in FIG. 2) of the rear end surface 56 of the head portion 52 of the center electrode 50.

A powder 74 of talc or the like held between a pair of a ring member 73 and a ring member 73 is disposed between the inner circumference of the tool engagement portion 62 of the metal shell 60 and the outer circumference of the trunk portion 21 of the first insulator 20. When the crimping portion 61 of the metal shell 60 is deformed to come into close contact with the ring members 73, the lock portion 24 is pressed toward the shelf portion 67 of the metal shell 60 via the ring members 73, the powder 74, and the protruding portion 22. As a result, the metal shell 60 is attached to the first insulator 20 via the packing 72, the ring members 73, and the powder 74. The packing 72 occludes a clearance between the shelf portion 67 and the lock portion 24.

The ignition plug 10 is manufactured by, for example, a method similar to the method below. First, the shaft portion 51 of the center electrode 50 is inserted into the axial hole 31 of the first insulator 20, and the head portion 52 is welded to the front end of the shaft portion 51. Next, the hole portion 29 is filled with a raw material powder of the sealing material 58, the metal terminal 57 is press-fitted into the hole portion 29, and the raw material powder of the sealing material 58 is compressed in the axial direction while being heated. The raw material powder is compressed and sintered, and conduction between the metal terminal 57 and the center electrode 50 is ensured by the sealing material 58. Next, the second insulator 40 is joined to the first insulator 20 by coupling the internal thread portion 44 of the second insulator 40 to the external thread portion 28 of the first insulator 20. Last, the metal shell 60 is assembled to the outer circumferences of the first insulator 20 and the second insulator 40 to obtain the ignition plug 10.

In the ignition plug 10, when the thread portion 66 of the metal shell 60 is attached to the threaded hole of the internal combustion engine (not shown), the second insulator 40 is exposed in a combustion chamber (not shown). The ignition plug 10 is a kind of a capacitor in which the center electrode 50 and the metal shell 60 are insulated from each other by the insulator 11. Thus, when an AC voltage or a plurality of times of pulse voltages are applied between the metal terminal 57 and the metal shell 60, a dielectric barrier discharge occurs between the center electrode 50 and the metal shell 60. The discharge causes the ignition plug 10 to ionize a gas (air-fuel mixture) into a non-equilibrium plasma state, thereby causing the air-fuel mixture to generate a flame kernel.

When the voltage applied between the metal terminal 57 and the metal shell 60 is constant, an amount of an electric charge stored in the insulator 11 is inversely proportional to the thickness of the insulator 11 interposed between the center electrode 50 and the metal shell 60. Thus, the thinner the thickness of the insulator 11 is, the more the amount of plasma generated at the surface of the second insulator 40 increases.

The ignition plug 10 includes the center electrode 50 provided with, at the front end, the head portion 52 that has an outer dimension larger than the thickness of the shaft portion 51; thus, the wall thickness at the front side of the insulator 11 can be thinned without reducing the outer diameter at the front side of the insulator 11 (that is, while ensuring the surface area at the front side of the insulator 11). Consequently, the amount of plasma generation can be increased, and ignitability can be improved.

In the meantime, when the outer diameter of the center electrode 50 is increased over the total length in the axial direction in order to increase the amount of plasma generation, the thickness of the insulator 11 interposed between the center electrode 50 and the metal shell 60 can be thinned; however, there is an issue, in turn, where it becomes easy for current to penetrate the insulator 11.

In contrast, in the ignition plug 10, the insulator 11 is divided into the first insulator 20 and the second insulator 40, and the center electrode 50 including, at the front end portion, the head portion 52 larger than the shaft portion 51 is disposed inside the insulator 11. Thus, the first insulator 20 (large-diameter portion 23 and small-diameter portion 25) surrounding the shaft portion 51 of the center electrode 50 can be thickened, and the second insulator 40 (cylinder portion 41) surrounding the head portion 52 can be thinned. Therefore, much plasma can be generated at the outer surface of the second insulator 40 while penetration in the first insulator 20 is suppressed.

Moreover, the head portion 52 having the outer diameter larger than the shaft portion 51 can be enclosed in the second insulator 40 while the shaft portion 51 of the center electrode 50 is covered by the first insulator 20 because the insulator 11 includes the two members of the first insulator 20 and the second insulator 40. Therefore, the center electrode 50 that includes the head portion 52 can be easily disposed inside the insulator 11.

Due to the structure in which the front side of the first insulator 20 is covered by the second insulator 40, the outer diameter of the head portion 52 covered by the second insulator 40 can be increased regardless of the size of the axial hole 31 of the first insulator 20. As a result, the amount of plasma generated at the outer surface of the second insulator 40 can be increased because the surface area of the second insulator 40 can be increased while the thickness of the insulator 11 is ensured.

The ignition plug 10 is suitable, in particular, for recent high-efficiency engines that have been developed to achieve small size, high output, and low NOx for the purpose of improving fuel economy and reducing $CO_2$. In high-efficiency engines, ignitability is sometimes poor due to a high degree of supercharging, high compression, and a weak air-fuel mixture. Therefore, it is expected that a gas (air-fuel mixture) in a combustion engine, in which a large area of the combustion chamber is ionized, is activated in the large area and that a reformed gas thereof improves ignitability and combustion efficiency. Note that the ignition plug 10 is applicable to various fuel systems of gasoline, light oil, gas fuel, and the like.

The front end surface 43 of the second insulator 40 protrudes further than the front end 68 of the metal shell 60 toward the front side (lower side in FIG. 2). Thus, the metal shell 60 is configured not to impede growth of a flame kernel. Therefore, the ignitability can be improved. Moreover, a portion (portion having a thin wall thickness) of the second insulator 40 surrounding the head portion 52 can be disposed outside the metal shell 60 because the rear end surface 56 of the head portion 52 is disposed on the front side of the front end 68 of the metal shell 60. Penetration easily occurs at a portion of the insulator 11 between the metal shell 60 and the center electrode 50; however, penetration in the insulator 11 can be further prevented from easily occurring by disposing the head portion 52 on the front side of the front end 68 of the metal shell 60.

The second insulator 40 is joined to the first insulator 20 by coupling the internal thread portion 44 to the external thread portion 28 of the first insulator 20. Thus, reliability in joining can be improved compared with the case where the second insulator 40 is joined to the first insulator 20 with, instead of screwing of the threads, only an inorganic adhesive.

The creepage distance of the outer circumference of the second small-diameter portion 27 and the inner circumference of the cylinder portion 41 can be lengthened by providing the internal thread portion 44 and the external thread portion 28 compared with the case where the internal thread portion 44 and the external thread portion 28 are not provided. As a result, a leak between the metal shell 60 and the head portion 52 along a path between the second small-diameter portion 27 and the cylinder portion 41 can be suppressed.

The shelf portion 67 of the metal shell 60 protrudes, over the entire circumference, inward further than the large-diameter portion 23 in the axial right-angle direction and supports the large-diameter portion 23 of the first insulator 20. Thus, the insulator 11 is held by the inner circumference of the metal shell 60 due to the large-diameter portion 23, which is provided at the first insulator 20, being supported by the shelf portion 67 of the metal shell 60. The thickness in the axial right-angle direction of the large-diameter portion 23 can be thickened compared with the case where the large-diameter portion 23 is provided at the second insulator 40 that covers the head portion 52 widening further than the shaft portion 51 in the axial right-angle direction. Therefore, the mechanical strength of the large-diameter portion 23 can be ensured.

In the second insulator 40, the cylinder portion 41 is present inside the metal shell 60, and thus, the cylinder portion 41 can be prevented from being exposed to a combustion gas inside the combustion chamber. Compared with the case where the entire portion of the second insulator 40 is exposed to the combustion gas, overheating of the second insulator 40 can be suppressed, and thus, ignition of the air-fuel mixture due to abnormal overheating of the second insulator 40 can be suppressed.

The cylinder portion 41 of the second insulator 40 is present inside the trunk portion 65 where the thread portion 66 is present at the outer circumference of the metal shell 60. Therefore, the heat of the second insulator 40 can be transmitted to the internal combustion engine (not shown) via the cylinder portion 41, the trunk portion 65, and the thread portion 66. As a result, overheating of the second insulator 40 can be suppressed, and thus, ignition of the air-fuel mixture due to abnormal overheating of the second insulator 40 can be further suppressed.

The inner diameter of a portion of the trunk portion 65 of the metal shell 60 on the front end 68 side of the shelf portion 67 is uniform to the front end 68, and thus, the wall thickness of the trunk portion 65 on the front end 68 side of the shelf portion 67 can be ensured. As a result, the heat capacity of the trunk portion 65 present outside the cylinder portion 41 of the second insulator 40 in the radial direction can be ensured. Moreover, the outer diameter of the cylinder portion 41 is substantially equal to the outer diameter of the first small-diameter portion 26 of the first insulator 20, and the wall thickness in the radial direction of the cylinder portion 41 is substantially equal to a difference between the outer diameter of the first small-diameter portion 26 and the outer diameter of the second small-diameter portion 27. Thus, a clearance between the trunk portion 65 and each of the first small-diameter portion 26 and the cylinder portion 41 can be reduced. Therefore, heat can be easily transmitted from the first small-diameter portion 26 and the cylinder portion 41 to the trunk portion 65. As a result, the overheating of the second insulator 40 can be suppressed, and thus, the ignition of the air-fuel mixture due to the abnormal overheating of the second insulator 40 can be further suppressed.

Figure 3:
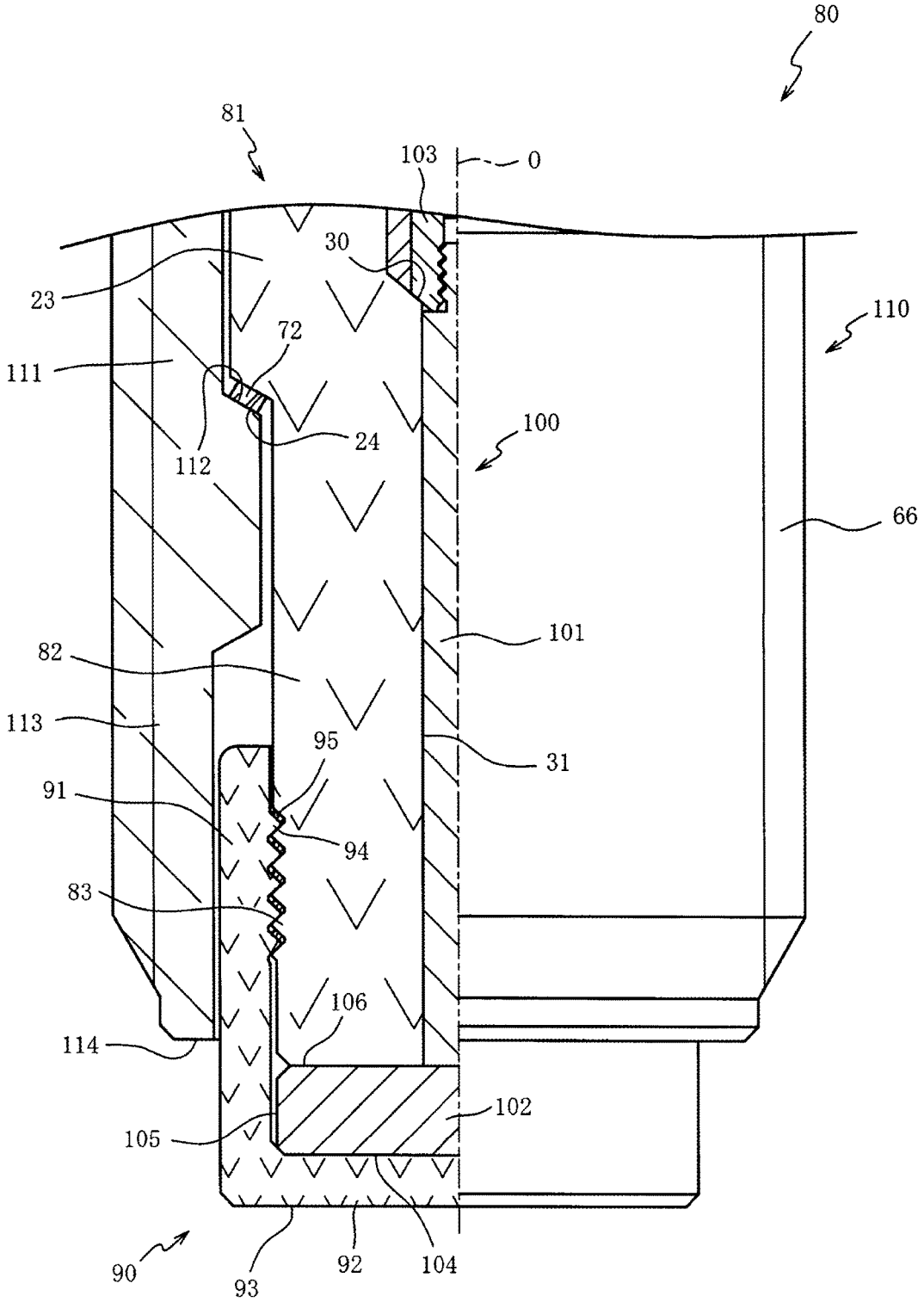
FIG. 3 is a half sectional view of an ignition plug according to a second embodiment.

With reference to FIG. 3, a second embodiment will be described. In the first embodiment, the case where the outer diameter of the head portion 52 of the center electrode 50 is smaller than the outer diameter of the first small-diameter portion 26 of the first insulator 20 is described. In contrast, in the second embodiment, the case where the outer diameter of a head portion 102 of a center electrode 100 is substantially equal to the outer diameter of a small-diameter portion 82 of a first insulator 81 will be described. Note that portions same as the portions described in the first embodiment are given the same reference characters, and further description thereof will be omitted. FIG. 3 is a half sectional view, with the axial line O as the border, of an ignition plug 80 according to the second embodiment. In FIG. 3, illustration of the rear side of the ignition plug 80 is omitted.

As illustrated in FIG. 3, the ignition plug 80 includes the first insulator 81, a second insulator 90, the center electrode 100, and a metal shell 110. In the first insulator 81, the large-diameter portion 23 and the small-diameter portion 82 are connected together in this order along the axial line O from the protruding portion 22 (refer to FIG. 1) to the front side. The outer diameter of the small-diameter portion 82 is smaller than the outer diameter of the large-diameter portion 23, and the outer diameter of the small-diameter portion 82 is substantially uniform over the total length of the small-diameter portion 82 in the axial line O direction. An external thread portion 83 is formed at the outer circumference at the front side of the small-diameter portion 82.

The second insulator 90 is a member that surrounds the circumference of the first insulator 81 on the front side of the small-diameter portion 82. The second insulator 90 includes a cylinder portion 91 and a bottom portion 92 that forms a front end surface 93 of the second insulator 90 and that closes a front-side opening of the cylinder portion 91. The outer diameter of the cylinder portion 91 is larger than the outer diameter of the small-diameter portion 82 of the first insulator 81. An internal thread portion 94 is formed at the inner circumference of the cylinder portion 91. The internal thread portion 94 is engaged with the external thread portion 83 of the small-diameter portion 82.

In the ignition plug 80, another member (filling material 95) that is different from the first insulator 81 and the second insulator 90 is disposed in a clearance between the internal thread portion 94 and the external thread portion 83. The filling material 95 has a heat-resisting property and an insulating property and comes into close contact with at least a part of each of the internal thread portion 94 and the external thread portion 83. In the filling material 95, for example, a composition containing an inorganic adhesive (so-called cement) and glass particles based on $B_2O_3$—$SiO_2$ or the like, or a composition similar thereto is used. The filling material 95 bonds the internal thread portion 94 and the external thread portion 83 to each other.

An effect of suppressing a leak along a path between the small-diameter portion 82 and the cylinder portion 91 can be enhanced because the filling material 95 having insulating property is disposed in the clearance between the internal thread portion 94 and the external thread portion 83 and comes into close contact with at least a part of each of the internal thread portion 94 and the external thread portion 83. Moreover, thermal conductivity between the internal thread portion 94 and the external thread portion 83 can be improved, which is although depending on the thermal conduction of the filling material 95, because the filling material 95 comes into close contact with the internal thread portion 94 and the external thread portion 83. Thus, heat diffusion from the second insulator 90 to the first insulator 81 can be improved.

The internal thread portion 94 is prevented from loosening with respect to the external thread portion 83 because the filling material 95 bonds the internal thread portion 94 and the external thread portion 83 to each other. In the ignition plug 80, the second insulator 90 is joined to the first insulator 81 by the internal thread portion 94, the external thread portion 83, and the filling material 95. Thus, reliability in joining the second insulator 90 can be improved.

The center electrode 100 is a conductive member that includes a rod-shaped shaft portion 101 and the head portion 102 provided at the front end of the shaft portion 101. The shaft portion 101 is formed of a nickel based alloy, nickel, or the like. An engagement portion 103 is provided at the rear end of the shaft portion 101. The engagement portion 103 widens further than the shaft portion 101 in the axial right-angle direction perpendicular to the axis line O and is engaged with the stepped portion 30 of the first insulator 81. The engagement portion 103 is coupled to the shaft portion 101 by threads.

The head portion 102 is a portion that widens further than the shaft portion 101 in the axial right-angle direction perpendicular to the axial line O. The head portion 102 has a front end surface 104, a side surface 105, and a rear end surface 106. In the present embodiment, the head portion 102 is formed of a nickel based alloy, nickel, or the like into a circular plate shape. The head portion 102 is disposed on the front side in the axial line O direction of the small-diameter portion 82 of the first insulator 81. The outer diameter of the head portion 102 is substantially equal to the outer diameter of the small-diameter portion 82 of the first insulator 81.

The second insulator 90 encloses the head portion 102. The front end surface 104 of the head portion 102 is covered by the bottom portion 92 of the second insulator 90, and the side surface 105 of the head portion 102 is covered by the cylinder portion 91 of the second insulator 90. In the present embodiment, the outer diameter of the cylinder portion 91 is uniform over the total length of the cylinder portion 91 in the axial line O direction.

In the metal shell 110, a trunk portion 111 and a leg portion 113 are connected to each other in this order along the axial line O from the seat portion 64 (refer to FIG. 1) to the front side. The thread portion 66 is formed at the outer circumference of the trunk portion 111 and the leg portion 113. A shelf portion 112 that protrudes inward in the radial direction is provided at the inner circumference of the trunk portion 111. The shelf portion 112 supports the large-diameter portion 23 of the first insulator 81 via the packing 72. The shelf portion 112 has a diameter that decreases toward the front side in the axial line O direction.

The leg portion 113 is a cylindrical section having an inner diameter larger than the minimum inner diameter of the shelf portion 112. In the present embodiment, the inner diameter of the leg portion 113 is uniform over the total length of the leg portion 113 in the axial line O direction. The leg portion 113 faces the center electrode 100 via the cylinder portion 91 of the second insulator 90 and the small-diameter portion 82 of the first insulator 81. The outer diameter of the second insulator 90 is larger than the minimum inner diameter of the shelf portion 112. In the present embodiment, a front end 114 of the leg portion 113 is positioned on the rear side (upper side in FIG. 3) of the front end surface 93 of the second insulator 90. In addition, the front end 114 of the leg portion 113 is positioned on the rear side (upper side in FIG. 3) of the rear end surface 106 of the head portion 102 of the metal shell 110.

The ignition plug 80 is manufactured by, for example, a method similar to the method below. First, the shaft portion 101 to which the head portion 102 of the center electrode 100 is joined in advance is inserted into the axial hole 31 of the first insulator 81, and the engagement portion 103 engaged with the stepped portion 30 is coupled to the shaft portion 101 by threads. After the filling material 95 is applied onto the external thread portion 83 of the first insulator 81, the internal thread portion 94 is screwed to the external thread portion 83, and the second insulator 90 is placed over the small-diameter portion 82 and the head portion 102.

Next, the hole portion 29 is filled with a raw material powder of the sealing material 58 (refer to FIG. 1), the metal terminal 57 is press-fitted into the hole portion 29, and the raw material powder of the sealing material 58 is compressed in the axial direction while being heated. The raw material powder is compressed and sintered to ensure conduction between the metal terminal 57 and the center electrode 100 by the sealing material 58. At the same time, the filling material 95 is heated to be hardened to join the first insulator 81 and the second insulator 90 to each other via the filling material 95. Next, the metal shell 110 is assembled to the outer circumference of the first insulator 81 and the second insulator 90 to obtain the ignition plug 80.

The outer diameter of at least a portion of the second insulator 90 of the ignition plug 80 on the front side (lower side in FIG. 3) of the metal shell 110 is larger than the minimum inner diameter of the shelf portion 112 of the metal shell 110. Thus, the surface area of a portion of the second insulator 90 protruding further than the front end 114 of the metal shell 110 to the front side can be increased compared with the first embodiment. Therefore, an amount of plasma generation can be increased.

When the surface area of the portion of the second insulator 90 protruding further than the front end 114 of the metal shell 110 to the front side can be increased, the outer diameter of the head portion 102 enclosed in the second insulator 90 can be increased. As a result, compared with the case where the center electrode 100 does not include the head portion 102 that widens further than the shaft portion 101 in the axial right-angle direction, the surface area of the second insulator 90 can be increased while the thickness of the insulator 11 is thinned. Thus, an amount of plasma generated at the outer surface of the second insulator 90 can be increased.

In the case where the insulator is not divided into two members of the first insulator 81 and the second insulator 90, it is difficult to provide the insulator (second insulator 90) having the outer diameter larger than the minimum inner diameter of the shelf portion 112 on the front side of the shelf portion 112 of the metal shell 110. However, the insulator (second insulator 90) having the outer diameter larger than the inner diameter of the shelf portion 112 can be easily provided on the front side of the metal shell 110 without being restricted by the inner diameter of the shelf portion 112 because the second insulator 90 is joined to the first insulator 81 disposed on the front side of the lock portion 24.

The present invention is described above on the basis of the embodiments; however, the present invention is not limited to the aforementioned embodiments in any aspect, and it is easy to conceive that the invention can be variously improved and modified within the scope of the spirit of the present invention.

In each of the aforementioned embodiments, the case where the second insulator 40, 90 is joined to the first insulator 20, 81 by the external thread portion 28, 83 and the internal thread portion 44, 94 is described; however, the embodiments are not necessarily limited thereto. Naturally, it is possible to join the second insulator 40, 90 to the first insulator 20, 81 by an inorganic adhesive.

Although description is omitted in the aforementioned embodiments, the external thread portion 28, 83 and the internal thread portion 44, 94 may be provided continuously or may be provided intermittently.

In each of the aforementioned embodiments, the case where the front end surface 43, 93 of the second insulator 40, 90 is positioned on the front side of the front end 68, 114 of the metal shell 60, 110 is described; however, the embodiments are not necessarily limited thereto. Naturally, it is possible that the front end surface 43, 93 of the second insulator 40, 90 is present (the second insulator 40, 90 is present inside the metal shell 60, 110) on the rear side of the front end 68, 114 of the metal shell 60, 110. This is because also in this case, the surface area of the head portion 52, 102 of the center electrode 50, 100 can be increased, and thus, the amount of plasma generated at the outer surface of the second insulator 40, 90 can be increased.

In each of the aforementioned embodiments, the case where the rear end surface 56, 106 of the head portion 52, 102 of the center electrode 50, 100 is positioned on the front side of the front end 68, 114 of the metal shell 60, 110 is described; however, the embodiments are not necessarily limited thereto. Naturally, it is possible that the rear end surface 56, 106 of the head portion 52, 102 is present on the rear side of the front end 68, 114 of the metal shell 60, 110 and that the front end surface 54, 104 of the head portion 52, 102 is present on the front side of the front end 68, 114 of the metal shell 60, 110. In addition, naturally, it is possible that the front end surface 54, 104 of the head portion 52, 102 is present on the rear side of the front end 68, 114 of the metal shell 60, 110 and that the front end surface 43, 93 of the second insulator 40, 90 is present on the front side of the front end 68, 114 of the metal shell 60, 110. This is because also in these cases, the surface area of the head portion 52, 102 of the center electrode 50, 100 can be increased, and thus, the amount of plasma generated at the outer surface of the second insulator 40, 90 can be increased.

In each of the aforementioned embodiments, the case where the outer diameter of the second insulator 40, 90 is uniform over the total length of the second insulator 40, 90 in the axial line O direction is described; however, the embodiments are not necessarily limited thereto. That is, in a process of manufacturing the ignition plug 10, 80, the second insulator 40, 90 can be joined to the first insulator 20, 81 from the front end 68, 114 side of the metal shell 60, 110 after the metal shell 60, 110 is assembled to the outer circumference of the first insulator 20, 81. Consequently, the outer diameter of the portion of the second insulator 40, 90 disposed on the front side of the metal shell 60, 110 can be increased so as to be larger than the inner diameter of the front end 68, 114 of the metal shell 60, 110 and the minimum inner diameter of the shelf portion 67, 112.

The amount of plasma generation can be increased because the surface area of the front end portion of the second insulator 40, 90 can be increased by increasing the outer diameter of the portion of the second insulator 40, 90 disposed on the front side of the metal shell 60, 110. Moreover, when the outer diameter of the second insulator 40, 90 is increased, the surface area of the second insulator 40, 90 can be increased while the thickness of the second insulator 40, 90 is maintained, by increasing the outer diameter of the head portion 52, 102 of the center electrode 50, 100. As a result, the amount of plasma generation can be further increased.

In each of the aforementioned embodiments, the case where the head portion 52, 102 of the center electrode 50, 100 is formed into the circular columnar shape; however, the embodiments are not necessarily limited thereto. The shape of the head portion 52, 102 can be determined, as appropriate. Examples of other shapes of the head portion 52, 102 include a circular plate shape, a spherical shape, a prism shape such as a hexagonal prism shape, and the like.

In the first embodiment, the case where the second insulator 40 is directly joined to the first insulator 20 is described, and in the second embodiment, the case where the second insulator 90 is joined to the first insulator 81 via the filling material 95 (another member) is described; however, each of the embodiments is not necessarily limited thereto. Naturally, it is possible to interpose a circular-ring shaped intermediate material (not shown) on which an external thread and an internal thread are formed, between the first insulator 20, 81 and the second insulator 40, 90, and to join the first insulator 20, 81 and the second insulator 40, 90 to each other via the intermediate material (another member).

In the first embodiment, the case where after the shaft portion 51 of the center electrode 50 provided with the engagement portion 53 is inserted into the axial hole 31, the head portion 52 is joined to the shaft portion 51 is described; however, the embodiment is not necessarily limited thereto. Naturally, it is possible to join the engagement portion 53 to the shaft portion 51 by threads or the like after the shaft portion 51 provided with the head portion 52 is inserted into the axial hole 31, similarly to the second embodiment. Naturally, it is also possible to configure the center electrode 100 described in the second embodiment similarly to the center electrode 50 in the first embodiment.

In the second embodiment, the case where the engagement portion 103 of the center electrode 100 to which the shaft portion 101 is joined and the metal terminal 57 are connected to each other by using the sealing material 58 is described; however, the embodiment is not necessarily limited thereto. Naturally, it is possible to omit the engagement portion 103 and the sealing material 58 and to join the shaft portion 101 to the metal terminal 57 by using threads or the like.

In each of the aforementioned embodiments, the case where the metal shell 60, 110 is crimped to the first insulator 20, 81 via the ring members 73 and the powder 74 is described; however, the embodiments are not necessarily limited thereto. Naturally, it is possible to crimp the metal shell 60, 110 by omitting the ring members 73 and the powder 74.

REFERENCE SIGNS LIST

10, 80: ignition plug
11: insulator
20, 81: first insulator
23: large-diameter portion
31: axial hole
40, 90: second insulator
50, 100: center electrode
51, 101: shaft portion
52, 102: head portion
60, 110: metal shell
67, 112: shelf portion
68, 114: front end
95: filling material (another member)
O: axial line

The invention claimed is:

1. An ignition plug comprising:
a rod-shaped center electrode that extends along an axial line from a front side to a rear side;
a cylindrical insulator that surrounds at least a circumference of a front end portion of the center electrode and that includes a bottom portion at the front side; and
a cylindrical metal shell that holds an outer circumference side of the insulator,
wherein the center electrode includes;
a shaft portion that extends along the axial line, and
a head portion that is disposed at a front end of the shaft portion and that has a width greater than that of the shaft portion in a radial direction of the center electrode, and
wherein the insulator includes;
a first insulator that has an axial hole in which the shaft portion is disposed and has a diameter smaller than a maximum diameter of the head portion, and
a second insulator that is joined to the first insulator and that encloses the head portion.

2. The ignition plug according to claim 1,
wherein the first insulator includes a large-diameter portion that protrudes outward in the radial direction, and
wherein the metal shell includes a shelf portion with which the large-diameter portion is locked, the shelf portion being provided on the front side of the large-diameter portion and protruding inward further than the large-diameter portion in the radial direction over an entire circumference.

3. The ignition plug according to claim 2, wherein an outer diameter of at least a portion of the second insulator on the front end of the metal shell is larger than a minimum inner diameter of the shelf portion.

4. The ignition plug according to claim 1, wherein the head portion is disposed on the front side of a front end of the metal shell.

5. The ignition plug according to claim 2, wherein the head portion is disposed on the front side of a front end of the metal shell.

6. The ignition plug according to claim 3, wherein the head portion is disposed on the front side of a front end of the metal shell.

* * * * *